United States Patent [19]

Kemper

[11] Patent Number: 5,031,248

[45] Date of Patent: Jul. 16, 1991

[54] DISPOSABLE PANTY

[75] Inventor: Alicia W. Kemper, Tallahassee, Fla.

[73] Assignee: Innovec, Inc., Tallahassee, Fla.

[21] Appl. No.: 255,984

[22] Filed: Oct. 11, 1988

Related U.S. Application Data

[63] Continuation-in-part of Ser. No. 78,967, Jul. 29, 1987, abandoned.

[51] Int. Cl.[5] ..... A41B 9/00

[52] U.S. Cl. ..... 2/406; 604/385.2; 2/400

[58] Field of Search ..... 2/402, 403, 404, 406, 2/407; 604/385.1, 385.2

[56] References Cited

U.S. PATENT DOCUMENTS

| | | | |
|---|---|---|---|
| 21,624 | 11/1940 | Dann | 2/224 |
| 362,565 | 5/1987 | Yarwood . | |
| 700,177 | 5/1902 | Crouse | 2/400 |
| 1,314,799 | 9/1919 | Guinzburg | 2/406 X |
| 1,474,044 | 5/1924 | Ward et al. | 2/406 |
| 1,709,177 | 4/1929 | Kosofsky . | |
| 1,975,688 | 10/1934 | Graves . | |
| 2,018,782 | 10/1935 | Gephart | 2/406 |
| 2,085,425 | 6/1937 | Goodwin . | |
| 2,088,800 | 8/1937 | Malouf . | |
| 2,206,412 | 7/1940 | Levy | 2/406 |
| 2,272,830 | 2/1942 | Brody et al. . | |
| 2,294,617 | 9/1942 | Horowitz . | |
| 2,401,457 | 6/1946 | Bryant . | |
| 2,419,867 | 4/1947 | Woodman | 2/406 X |
| 2,427,906 | 9/1947 | Golightly | 2/406 X |
| 2,464,121 | 3/1949 | Diebold . | |
| 2,632,177 | 3/1953 | McFerin . | |
| 2,638,900 | 5/1953 | Gruenberg et al. . | |
| 2,743,456 | 5/1956 | Yarnell . | |
| 2,821,719 | 2/1958 | Meaker . | |
| 2,910,982 | 11/1959 | Woodward | 604/385.1 |
| 3,237,625 | 3/1966 | Johnson . | |
| 3,397,696 | 8/1968 | Rickard . | |
| 3,397,697 | 8/1968 | Rickard | 128/288 |
| 3,463,154 | 8/1969 | Hendricks . | |
| 3,527,222 | 9/1970 | June . | |
| 3,560,292 | 2/1971 | Butter | 2/406 X |
| 3,594,820 | 7/1971 | McCurry . | |
| 3,921,221 | 11/1975 | Zoephel | 2/51 |
| 4,227,531 | 10/1980 | McLeod | 2/406 |
| 4,280,230 | 7/1981 | LaFleur . | |
| 4,351,340 | 9/1982 | McLeod | 2/406 |
| 4,414,691 | 11/1983 | Estruch | 2/400 |
| 4,586,199 | 5/1986 | Birring | 2/401 |
| 4,674,135 | 6/1987 | Greene | 2/400 |
| 4,728,326 | 3/1988 | Gilles | 604/385.1 |
| 4,834,741 | 5/1989 | Sabee | 604/385.2 |

FOREIGN PATENT DOCUMENTS

| | | | |
|---|---|---|---|
| 155636 | 9/1985 | European Pat. Off. | 604/385.1 |
| 1491234 | 4/1969 | Fed. Rep. of Germany | 604/385.1 |
| 2566631 | 1/1986 | France | 604/385.1 |
| 2023431 | 1/1980 | United Kingdom | 604/385.1 |

*Primary Examiner*—Werner H. Schroeder
*Assistant Examiner*—Diana L. Biefeld
*Attorney, Agent, or Firm*—Arthur G. Yeager

[57] ABSTRACT

Disposable panty made of a flat thin sheet material having a soft fibrous material inside and a moisture impervious plastic film outside, the integral panty blank having a triangular front portion, a triangular rear portion and a narrow crotch strip and tape members. The tape members may extend laterally from the front and rear portions to form a waist encircling member in several embodiments and can extend only from the rear portions and can be connectable to the front portion by a releasable adhesive tab or the like. Each of the front and rear portions preferably includes an adjusting or expanding part to selectively expand the areas of the front or back portions and the length of the waist encircling member.

26 Claims, 3 Drawing Sheets

DISPOSABLE PANTY

RELATED APPLICATION AND DISCLOSURE DOCUMENTS

This application is a continuation-in-part application of my copending application Ser. No. 078,967, filed July 29, 1987 entitled Disposable Panty, and now abandoned and the Disclosure Document Nos. 156919, dated Oct. 6, 1986 and 168704 dated Apr. 13, 1987, set forth herein.

BACKGROUND OF THE INVENTION

Despite the increases in genitally transmitted diseases, there has been no cheap and disposable hygienic product for the genital areas of persons in trying on clothing. When a prospective customer wishes to try on body wear, i.e., swim suits, lingerie, dance wear and athletic wear, such body wear becomes exposed to the unsanitary conditions of such customer or a prior customer. Women are particularly vulnerable to said conditions. Also, soilage of swim suits and the like often causes store owners to discard the merchandise.

Most store policies, not state or federal regulation or law, require that a person who wishes to try on an undergarment before buying it must wear underwear when trying on the new clothing so as to minimize the spread of disease and damage to the clothing. Such a safeguard measure, while helpful, does not sufficiently protect the body wear because the undergarment is often moist and therefore, can readily transmit many diseases, germs, bacteria, lice and the like. An inexpensive disposable undergarment would be more effective and should be required for those trying on underwear, swim suits, and any other clothing worn next to or adjacent the skin around the genital areas.

There have been two known attempts to provide such a garment. U.S. Pat. Nos. 2,206,412 to Levy and 2,272,830 to Brody et al describe such items. In both instances the garment is a flat piece of fabric cut into the general shape of an hour glass and having tie strings extending laterally from both ends of the cut-out fabric. The garment is merely centered over the crotch between the legs and the two larger portions of the fabric pulled upward with tie strings tied together to form a waist encircling string. Levy makes the garment from an "absorbent . . . fibrous tissue", while Brody et al uses "waterproof paper". These prior art items are perhaps too simple since they do not provide both comfort and moisture impermeability; they require tying of the strings and, furthermore, they are not capable of providing a smooth fit for torsos of many different sizes. Women who wish to try on, for example, a swim suit need the undergarment to fit smoothly around the body so the fit and look of the swim suit can be accurately assessed with the undergarment being hidden and otherwise unobtrusive.

In the field of dressing room hygiene for the genital area and/or soilage protectors, the prior art discloses the aforesaid tie-on paper undergarments of Levy and Brody et al which offer little soilage protection and even less hygienic protection for the next customer and are exceedingly difficult to affix about the body of a wearer. Also, they do not conform to the curvature and contours of the body of a wearer and are bulky and interfere with the wearer's ability to determine how the garment will actually appear without such paper undergarment.

More importantly they are not efficient in use or effective in inhibiting germ transmissions to the garment and do not effectively prevent soilage.

Panty liners have also been used and these are somewhat more effective against soilage and germ transmission only in the area covered by the liner. However, this presumably would require a different liner for each garment and be costly to the customer and/or store owner. Liner use would also make the customer place the pad in the crotch which means that the hands would likely contact the area which may be contaminated and thus soil other parts of the garments.

A few manufacturers of swim wear have provided adhesive backed strips placed in the crotch which may provide a one-time guard against soilage only, if confined to such strip, and this strip can be removed. Of course, no hygienic protection is afforded to the next prospective customer unless removal has taken place.

In accord with this invention the aforementioned difficulties and deficiencies are substantially overcome.

In contrast the invention herein disclosed is thoroughly protective of both the entire genital area and the garments to be tried on. The customer requires only one of these disposable panties regardless of the number of garments to be fitted. The improved panty provides a substantial time and energy savings over the use of paper undergarments and panty liners. Its obvious effectiveness, efficiency and convenience and minimal cost in tandem with the growing public consciousness of the need for hygienic precautions of many types against communicable diseases will provide for customer acceptance and use.

It is an object of this invention to provide an improved disposable undergarment for use in trying on swim suits, underwear, shorts, pants and the like. It is another object of this invention to provide a disposable undergarment which is expandable to fit any size in the range of differences of the human bodies. Also, the improved garment is inexpensive in its manufacture, easily used about the body without the necessity of tying, and sufficiently rugged in use with or without the normal panties worn by women. Still other objects will appear from the more detailed description which follows.

BRIEF SUMMARY OF THE INVENTION

This invention relates to a disposable panty comprising a flat thin sheet material with a soft inside surface and a moisture impervious outside surface, and the sheet material being continuous and being shaped to include a narrow crotch strip as a central portion jointed at one end to a generally triangular front portion. Laterally extending tape elements at each end of the sheet are adapted to form a waist band or a draw string when the panty is placed over the lower torso of a body.

In one preferred embodiment the rear portion and the front portion have means to selectively expand the area of these portions and the waist size of the panty.

In another preferred embodiment the means to expand the panty size is a releasable pleat or a gathering which can easily be expanded to fit a larger torso.

Other aspects of the invention are directed to the slidable clamping means on at least one side for adjusting the waist band length, or on both sides of a wearer. Also a snap means in one embodiment connects the tape elements with stretchable gatherings being located adjacent the upper edges of the front and rear portions of the panty to permit good and tight body encirclement of a wearer.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
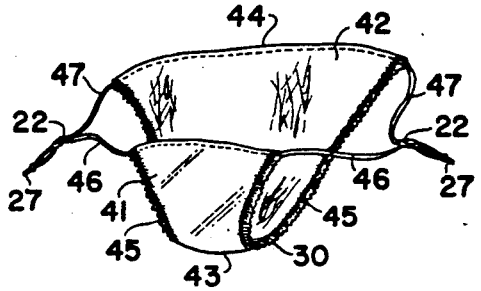
FIG. 1 is a perspective illustration of the first embodiment of the disposable panty in accord with this invention as it is intended to be worn.

The features of this invention can best be appreciated by reference to the attached drawings.

The panty is essentially a flat, thin piece of sheet material cut into the general shape of an hour glass which can be placed between the legs of the wearer and pulled up in the front and the back in the manner of a baby's diaper to cover the abdomen and the buttocks with a band around the waist to hold the garment in place. In certain embodiments of this invention, one size of panty fits substantially all sizes of torso by reason of an expansion means described below, and one panty is suitable for both sexes. There are three portions of the garment; namely, a narrow crotch strip 43 integrally joined at one end to a smaller triangular front portion 41 and at the other end to a larger triangular rear portion 42. When front portion 41 is pulled upward to cover the abdomen and rear portion 42 is pulled upward to cover the buttocks, edges 45 will encircle the legs of the wearer, with waist edges 44 and tapes 47 joined together at the two sides to make a waist encircling band or belt. The exact ContOUrs of portions 41, 42 and 43 and of waist edges 44 and edges 45 may be curved or straight or made in whatever preferred shape to best match the body contours of the wearer.

Figure 2:
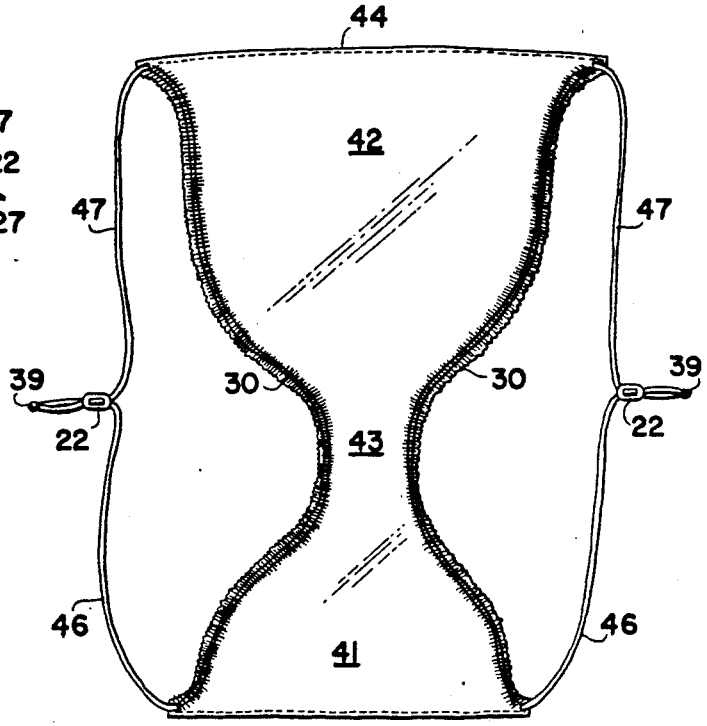
FIG. 2 is a top plan view of the panty in blank form as it is manufactured.

In its simplest form the panty is as shown in FIGS. 1 and 2. Front portion 41, rear portion 42 and crotch strip 43 are cut out of a single continuous sheet having no stitching to join one portion to another, so that the panty will be germ and moisture-proof. Preferably, leg edges 45 are gathered as at 30 with one or two strips of elastic material running parallel to edges 45. This provides a snug fit around the legs. The waist band is a tape, elastic or not, which is attached to the four corners of the blank in FIG. 2, the tapes 46 and 47 on the same side being joined through a slideable clamp 22 and the ends of the tape being knotted or heat sealed into a globule 39. This type of disposable panty is not expandable into larger sizes and should be provided in several sizes; small, medium, large, extra large, to fit any torso.

Figure 3:
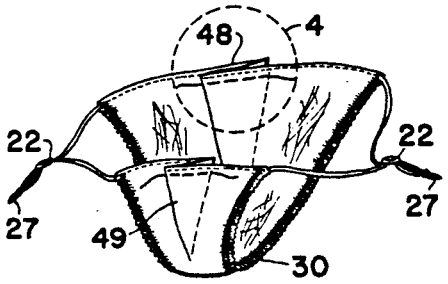
FIG. 3 is a perspective illustration of a second embodiment of the invention including an expandable panty having a releasable pleat.
Figure 4:
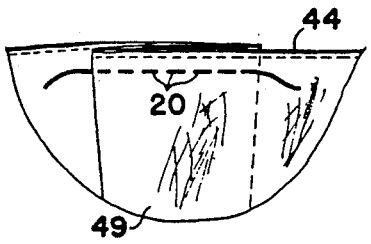
FIG. 4 is an enlarged view of the portion shown in area 4 in FIG. 3.

Among the principal features of this invention are expansion insets 48 and 49 in the central area of front portion 41 and rear portion 42, respectively. Expansion insets 48 and 49 m be made in various ways for use in making the panty fit larger sizes of torso. In FIGS. 3 and 4 it may be seen that one embodiment of the expansion inset 48 or 49 is one or more darts or folded pleats which are temporarily tacked together by a basting thread 20. Thread 20 may be manually pulled from its stitches make the area of front portion 41 or back portion 42 larger as well as to make the circumferential length of waist edges 44 an tapes 46 and 47 longer. In place of a dart for pleat 48, 49 there may be employed an elastic section which will expand inherently or other expandable means, such as illustrated at 30 and 31 in FIG. 5, which may be designed by those skilled in the art. It is desired that whatever the means of expansion, the panty should fit snugly and unobtrusively beneath a swim suit or shorts or the like. This permits the best possible arrangement in deciding whether clothing being tried on will look well on the wearer, particularly those items which fit close to the body.

Figure 6:
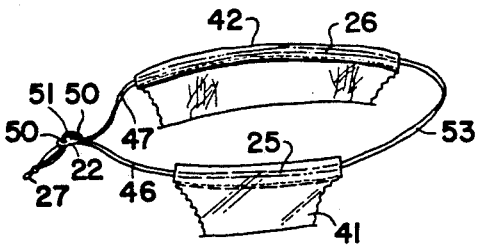
FIG. 6 is a partial view of a second preferred means for fastening the panty around the waist with an adjustable tape.
Figure 5:
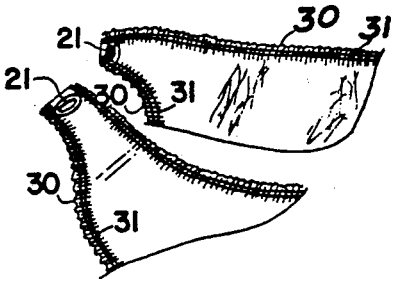
FIG. 5 is a partial view of one means for fastening the panty around the waist of a wearer.

In FIGS. 5 and 6 there are shown other means for fastening the panty around the waist of the wearer. Tapes 47 are not, in accord with this invention, to be tied into knots by the wearer because is difficult and time consuming. Also, if a knot were tied, it may present problems in removing the panty. If the corners of the panty are long enough to reach around the waist a snap fastener 21, as shown in FIG. 5, may be used. Tapes 46 and 47 may be integral parts of the front portion 41 or the rear portion 42 or they may be separate and passed through belt loops or tunnel loops as generally shown in FIG. 6. In the form of tapes 46 and 47, which may or may not be elastic, they may be caught by adjustable fastening devices, such as the slideable clamp 22 shown in FIG. 6 where both tapes 46 and 47 are threaded through two adjacent holes 50 in clamp plate 51 and are held in any selected location by the friction forces between the tapes 46 and 47 and the surfaces about the holes 50 in plate 51.

Tapes 46 and 47 beyond clamp plate 51 are knotted at 27 or heat welded (39 in FIG. 2) to prevent clamp 51 from sliding off the tapes. The particular embodiment in FIG. 6 shows that when there are tunnel loops 25 and 26 in the panty portions 41 and 42, tapes 46 and 47 may be a single tape with only one clamping device 22 needed while the other side 53 is a continuous, unbroken section of tape 46, 47.

Figure 7:
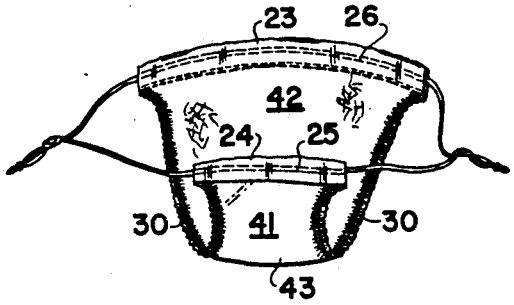
FIG. 7 is a perspective illustration of a third embodiment of the panty of this invention.
Figure 8:
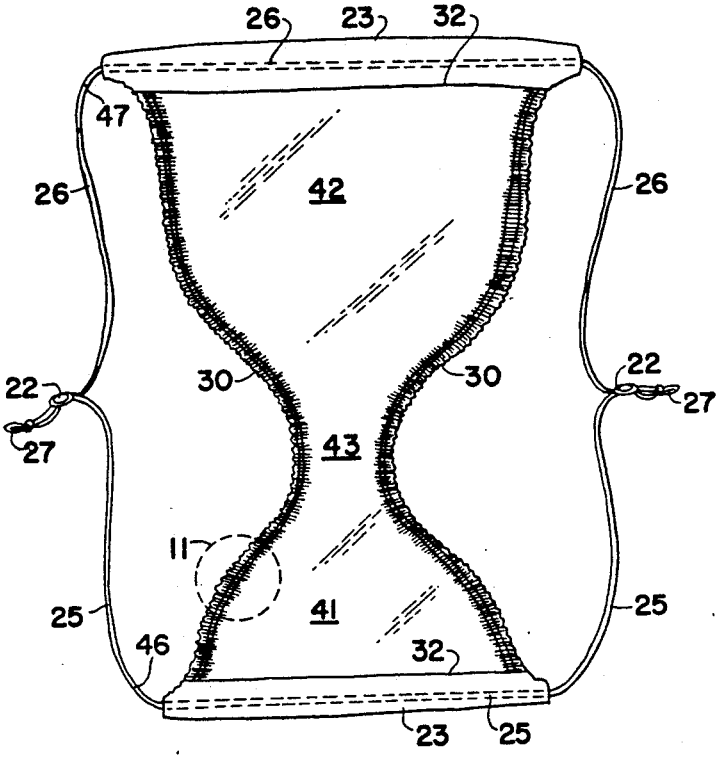
FIG. 8 is a top plan view of the panty of FIG. 7 in the blank form.
Figure 9:
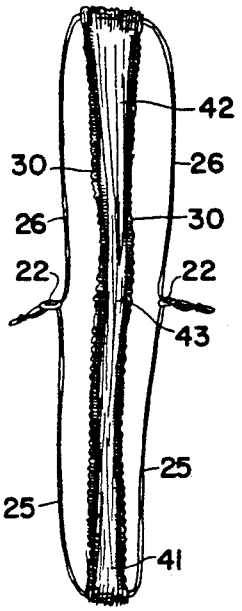
FIG. 9 is an illustration of the panty of FIGS. 7–8 in a narrow folded condition.
Figure 10:
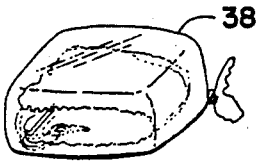
FIG. 10 is an illustration of a small package into which the folded panty of FIG. 9 can be stored after further folding.

In FIGS. 7 and 8 there is shown a third embodiment of the panty of this invention wherein the expansion means is a gathering 23 of the sheet material along tapes 25 or 26 in tunnel loops formed by hem 32 in the sheet material. In putting on the panty as much of gathering 23 as is needed is expanded outwardly and tapes 25 and 26 are clamped together. For storage purposes, the panty is compressed into its narrow folded condition of FIG. 9 and folded laterally to form a very small mass which may be placed in a small plastic bag as in FIG. 10 or other suitable package. Tapes 46, 47 in the panty of FIG. 8 are shown tunnel loops 25 and 26 made by forming a hem or an inward or outward fold at the waist edge of front and rear portions 41 and 42, the outward fold being preferable for enhanced comfort of the wearer.

Figure 11:
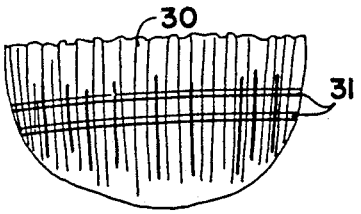
FIG. 11 is an enlarged partial view of portion 11 in FIG. 8.

A preferred feature is to provide a gathered edge 30 around crotch strip 43, leg edges 45, or other portions, for comfort and better fit. As seen in FIG. 11, this may be accomplished by incorporating at least one strip 31 of elastomeric material into the edge of the panty in one or more spaced parallel lines conforming generally to the respective edges 30. This may be done by heat sealing methods, gluing, or any other means of attachment.

Figure 12:
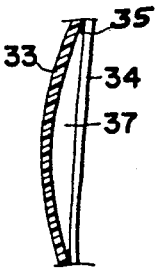
FIG. 12 is a cross sectional view of one type of sheet material used in this invention.
Figure 13:
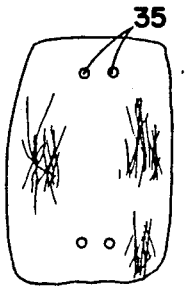
FIG. 13 is a top plan view of the sheet material of FIG. 12.
Figure 14:
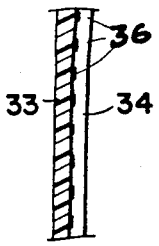
FIG. 14 is a cross section of a second type of sheet material used in this invention.
Figure 15:
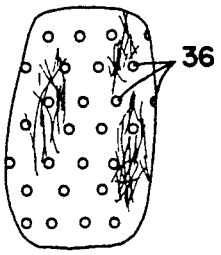
FIG. 15 is a top plan view of the sheet material of FIG. 14.

The preferred material for use in the panty of this invention is a combination sheet material having a thin outer layer of a moisture impervious plastic film and a thin inner layer of a soft fibrous fabric or paper. The soft layer, which may be paper or other fiberous fabric, is on the side next to the body of the wearer and the plastic film moisture barrier is on the outside of the panty and would provide a smooth surface over which the swim suit, underwear, other clothing could be put on or taken off rapidly and easily. The plastic film must be a good moisture barrier to prevent passage of not only moisture, but more importantly, germs, bacteria, or the like. Such plastics as polyolefins, polyesters, polyamides are suitable for this purpose. Soft paper tissue or fabric may be any material suitable for the purpose, such as that in modern disposable diapers, paper tissue, spun plastic tissue, etc., particularly desirable are those materials which are strong enough to be used in a single layer of 0.001–0.002 inch in thickness so as to keep the panty very thin. In FIGS. 12–15 are shown two types or sheet material usable in this invention. In FIGS. 12–13 the material has two separate layers 33 and 34 which are joined only at widely spaced locations 35, as by spot heat sealing, and thereby leaving large portions of the sheet material with free space 37 between plastic outer layer 33 and tissue inner layer 34. If both layers are plastic, heat sealing is the preferred method of joining at 35; otherwise adhesive can be used. In FIGS. 14–15 the two layers 34 and 35 are essentially laminated by many closely spaced sealing spots 36, which may be applied by a patterned roller.

Figure 16:
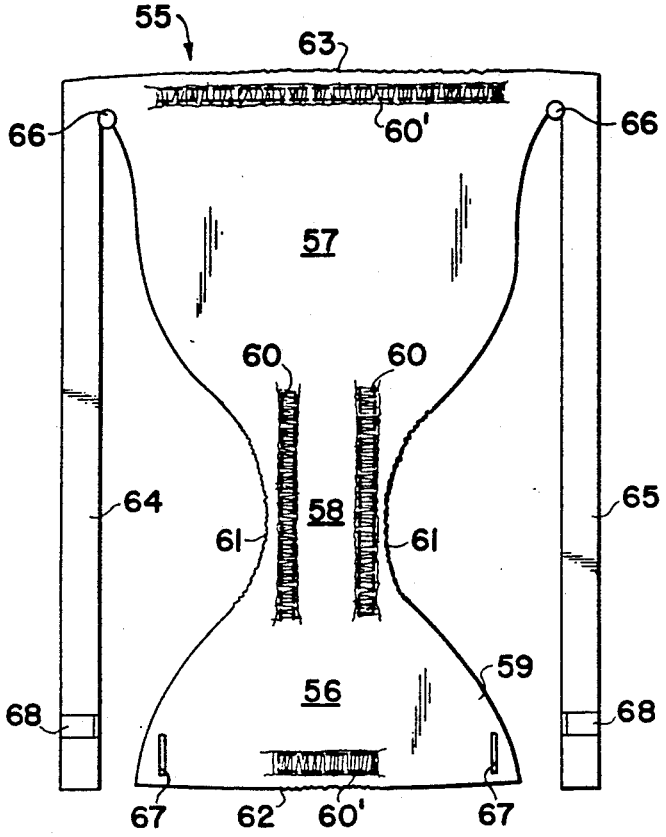
FIG. 16 is a top plan view in blank form of a fourth embodiment of the panty of this invention.

In according with a fourth embodiment of the invention, panty 55 is shown in FIG. 16 and includes a front portion 56, a rear portion 57 and a crotch strip portion 58 conforming generally to previous portions 41, 42 and 43 shown in FIGS. 1, 2, 7 and 8. As previously noted the soft fibrous inner layer 59 covers a pair of spaced substantially parallel elastic bands 60 extending along the respective edge portions 61 of the crotch portion 58 to more adequately conform the panty to and generally seal against the wearer's crotch and preferably similar elastic bands 60' extend along the opposite edge ends 62 and 63 of respective front and rear portions 56, 57 to permit fitting same to different size lower torso of bodies. The elongated waist band portions 64 and 65 are made integral with the rear portion 57 and reinforcements 66, as by spot heat sealing and or an adhesive type tape material spots, may be provided if desired to inhibit inadvertent tearing during use thereof.

Figure 17:
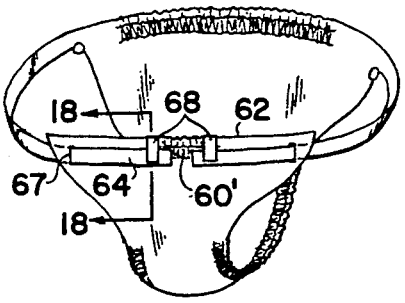
FIG. 17 is a perspective illustration of the panty of FIG. 16.
Figure 18:
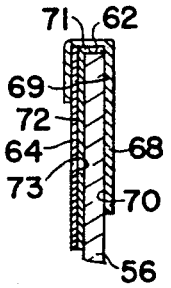
FIG. 18 is a partial enlarged cross-sectional view taken along line 18—18 of FIG. 17.

Means for attaching the portions 64 and 65 are provided by the spaced slots 67 through which respective portions 64 and 65 are threaded outwardly and an adhesive attachment tab 68 carried by each end of portions 64 and 65 is peeled off and folded over the top edge 62 of front portion 56, as hereinafter more clearly shown and described in connection with FIGS. 17 and 18. Tabs 68 may include a piece of tape 69 having an adhesive covering 70, a leg 71 affixed to a band portion 64 with another adhesive piece of tape 72 having a non-sticky and preferably a glossy surface 73 aligned with and carrying tab 68 with adhesive covering 70 being releasably secured to glossy surface 73. Thus, tab 68 can be lifted to a position shown in FIG. 18 with the upper edge 62 of portion 56 inserted between 68 and 73 and thence tab 68 is pressed onto portion 56 to secure the band portion 64 to the inner layer 59. While it is noted that only one tab 68 could be provided to either band portion 64 or 65 greater ability to fit different sizes of lower torso of bodies results from a tab 68 on each band portion.

Figure 19:
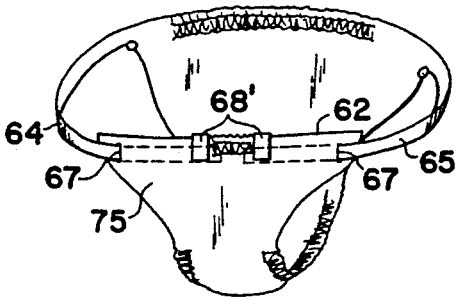
FIG. 19 is a perspective illustration like FIG. 17 but showing an alternate attachment.
Figure 20:
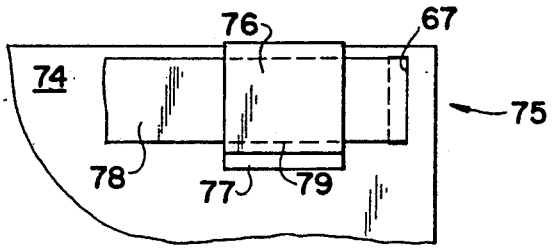
FIG. 20 is a partial elevational view of a fifth embodiment of the panty of this invention.

As shown in FIG. 19, the tabs 68', and a corresponding piece like 72, could be positioned such that band 64 is threaded inwardly to be flat against inner layer 59 and tab 68' is then folded outwardly over edge 62 to adhesively connect same to the outer plastic moisture impervious layer 74.

As illustrated in the fifth embodiment of the panty 75, a tab 76 and corresponding glossy piece 77 may be attached to the panty adjacent a slot 67 so that the band 78 may be releasably attached to and between 76 and 77. In this embodiment it is to be understood that 76 and 77 may have their respective cooperating faces on the inside or the outside of the panty 75 without departing from the spirit or scope of the invention. It is to be noted that it is preferable that the width of band 78 should be less than the adhesive face on tab 76 so that the adhesive face will stick to band 78 and at its free end 79 to glossy piece 77 which firmly affixes the band 78 in place.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A disposable and foldable thin panty comprising a flat very thin sheet having an inside and outside surface and a moisture and germ impervious outside surface, a very thin soft material on said inside surface, said outside surface maintaining its moisture and germ impervious qualities even during folding thereof, said sheet being continuous and being shaped to include a narrow crotch strip as a central portion joined at one end to a generally triangular rear portion and at the other end to a generally triangular front portion, said front portion being smaller in area than said rear portion, laterally extending elements attached to said sheet adapted to form a waist band when said panty is placed temporarily over the lower torso of a body, said crotch strip having no openings through said outside surface to inhibit moisture or germ transmission onto garments being tried by a user said very thin sheet and said very thin soft material being coplanar throughout without any absorbent pad along said crotch strip so that they form a thin panty unuseable as a diaper, said very thin and soft material being located adjacent a lower torso of a body of a user with said very thin sheet facing outwardly of a body of a user and said laterally extending elements all being snugly adjacent a lower torso of a body and unobtrusively beneath garments being tried by a user whereby a user can determine the exact fit of such garments while such garments are protected from moisture or germ transmission from a user and vice versa.

2. The panty of claim 1 which additionally comprises means to selectively expand the area of said front portion and the area of said rear portion.

3. The panty of claim 2 wherein said means to selectively expand includes at least one pleat extending from said waist band toward said crotch strip.

4. The panty of claim 3 further comprising heat welds for releasably fastening said pleat to said panty adjacent said waist band.

5. The panty of claim 3 further comprising adhesive means for fastening said pleat to said adjoining material.

6. The panty of claim 3 further comprising basting thread which is removable to release said pleat.

7. The panty of claim 3 wherein said pleat is releasably fastened to said front portion or said rear portion, respectively by a basting thread adjacent said waist band.

8. The panty of claim 2 wherein said means to selectively expand includes a gathering of said sheet material about said tape member along said front and rear portions.

9. The panty of claim 1 wherein said sheet material is a combination of a layer of soft tissue material and a layer of moisture impervious plastic film outwardly thereof.

10. The panty of claim 1 wherein each said element is a length of tape adapted to be adjustably tightened around a torso of a user.

11. The panty of claim 1 wherein each said element is separate from said sheet, said sheet having a pair of upper edges and a tunnel loop formed adjacently below each said edge, said elements being a single tape extending through both said loops and having an adjustable clamp to tighten said tape on one side of said panty.

12. The panty of claim 1 wherein said front and rear portions include lateral edge portions, stretchable gatherings carried by said lateral edge portions to fit said crotch central portion snugly adjacent legs of a wearer.

13. The panty of claim 1 which additionally includes a sliding keeper through which two said elements are slidable and selectively clampable thereby at any location therealong.

14. The panty of claim 1 further comprising snap means between adjacent said elements for selectively fastening said elements to each other.

15. The panty of claim 14 further comprising stretchable gatherings adjacent upper edges of said front and rear portions.

16. The panty of claim 1 wherein said rear and front portions each have an upper waist edge portion spaced remotely from said crotch strip means extending along said waist edge portions to selectively expand the area of said portions and the circumferential length of said waist band.

17. The panty of claim 1 wherein said crotch central portion includes lateral edge portions, means extending along said lateral edge portions to snugly fit said crotch central portion adjacent inside legs of a wearer.

18. The panty of claim 1 wherein each said laterally extending element comprises a plurality of tape members integral with respective said front and rear portions and extending laterally outwardly thereof adjacent and forming an encirclement of a waist of a wearer.

19. The panty of claim 1 wherein said laterally extending elements comprises a tape member, said front and rear portions having upper edges formed with tunnels therebelow through which said tape is slidingly disposed.

20. The panty of claim 1 wherein said laterally extending elements are a single length of tape with its opposite free ends being adjacent each other on a side of a wearer, a releasable clamping means connected to said free ends to adjust the length of said tape to a waist of a wearer.

21. The panty of claim 1 wherein said laterally extending members includes at least one tape member and at least one slidable clamping means on said tape member with a pair of adjacent tape sections being engaged by said clamping means to adjust the length of said tape member to a waist of a wearer.

22. The panty of claim 1 wherein said laterally extending members includes at least one tape member and at least two slidable clamping means on said tape member with a pair of adjacent tape sections being engaged by respective said two slidable clamping means on either side of a wearer to adjust the length of said tape member to a waist of a wearer.

23. A disposable and foldable thin panty of a thin flat sheet material of an inner, very thin and soft fibrous material joined to an outer moisture and germ impervious very thin plastic film, said plastic film maintaining its moisture and germ impervious qualities even during folding thereof, said panty including a front expandable portion and a rear expandable portion joined to a central narrow crotch strip, each of said front and rear portions having a waist edge portion lateral to and distant from said crotch strip and two leg edge portions joining the respective ends of said waist edge portions to said crotch strip, said very thin and soft fibrous material and said very thin plastic film being flat and forming said thin panty without any absorbent pad along said crotch strip whereby said thin panty is unuseable as a diaper, fastening means including a pair of elongated members having free end portions and extending laterally from respective ends of said rear waist edge portion and adapted to form a waist band portion, said fastening means further including a pair of spaced slots through said front waist edge portion to receive therethrough respective said free end portions, said fastening means further including selective means between said front portion and said elongated members to temporarily attach said elongated members to said front portion, said crotch strip having no openings therethrough to inhibit moisture or germ transmission onto garments being tried by a user after placing said panty temporarily over a lower torso of a body, means in each of said front and rear portions to selectively expand the area of said portions and the circumferential length of said waist band portion, said very thin and soft fibrous material being located adjacent a lower torso of a body of a user with said very thin plastic film facing outwardly of a body of a user and said fastening means including said selective means all being snugly adjacent a lower torso of a body and unobtrusively beneath garments being tried by a user whereby a user can determine the exact fit of such garments while such garments are protected from moisture or germ transmission from a user and vice versa.

24. The panty of claim 23 wherein said selective means is attached to each said free end portion.

25. The panty of claim 23 wherein said selective means is attached to said front portion of said panty adjacent said front waist edge portion.

26. The panty of claim 23 wherein said fastening means includes a tape having an adhesive surface.

* * * * *